United States Patent [19]

Yale

[11] 4,159,813

[45] Jul. 3, 1979

[54] RECIPROCATING TRAVERSE MECHANISM

[75] Inventor: Thomas L. Yale, Yarmouth, Me.

[73] Assignee: Yale Engineering Inc., Yarmouth, Me.

[21] Appl. No.: 843,588

[22] Filed: Oct. 19, 1977

[51] Int. Cl.[2] ..... B65H 54/28

[52] U.S. Cl. ..... 242/158.4 A; 74/58; 74/424.8 A

[58] Field of Search ..... 242/158.4 A, 158.4 R, 242/158.2; 74/58, 424.8 R, 424.8 A

[56] References Cited

U.S. PATENT DOCUMENTS 2,437,725 3/1948 Conner ..... 242/158.4 A

FOREIGN PATENT DOCUMENTS 346869 4/1931 United Kingdom ..... 242/158.4 A

*Primary Examiner*—Stanley N. Gilreath
*Attorney, Agent, or Firm*—Kenway & Jenney

[57] ABSTRACT

A traversing carriage has a shift member movable thereon which bears a pair of partial nuts for alternate engagement with each of two lead screws. A pair of latches are mounted on the carriage, each adapted to retain one of the partial nuts in engagement with a lead screw. Latch actuators are located to trip the latches and to operate the shift member when the carriage reaches predetermined limits of traverse.

12 Claims, 5 Drawing Figures

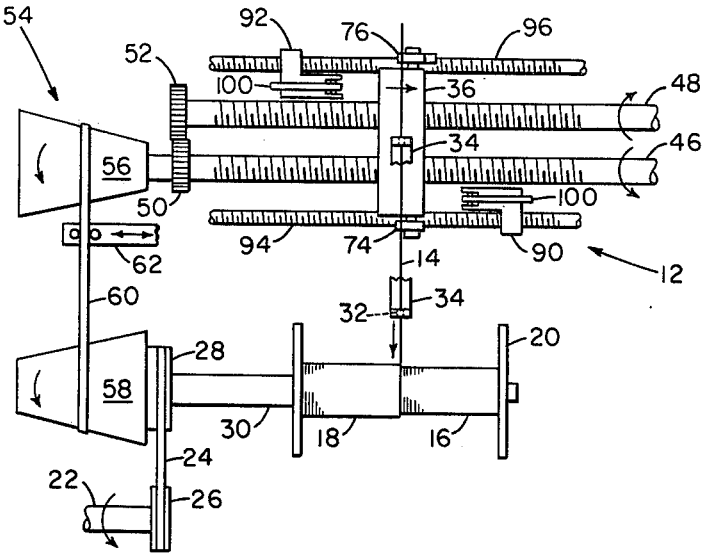
FIG. 1
FIG. 2
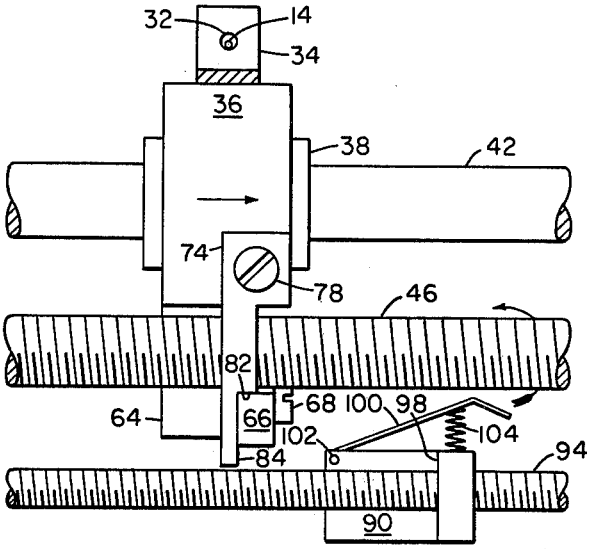
FIG. 3
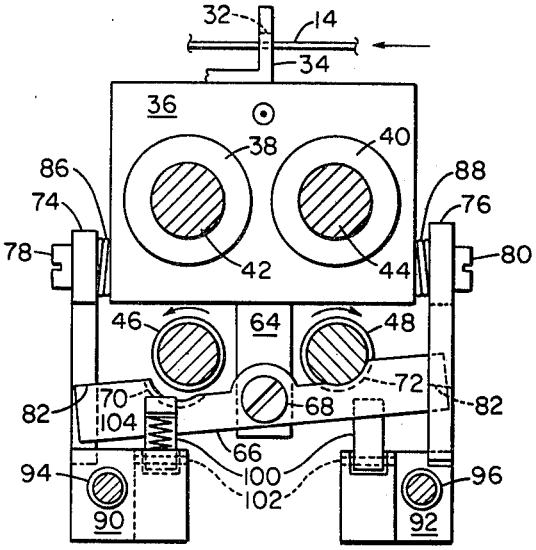
FIG. 4
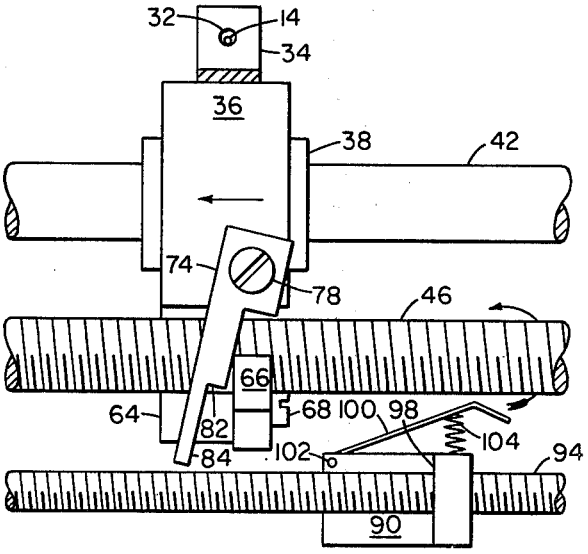
FIG. 5
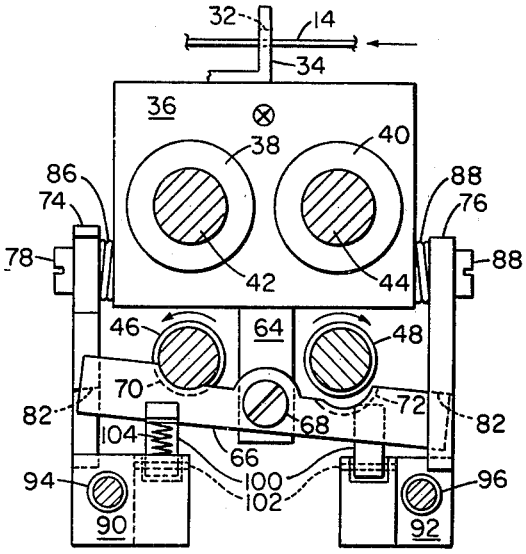

RECIPROCATING TRAVERSE MECHANISM

BRIEF SUMMARY OF THE INVENTION

This invention relates generally to traversing mechanisms, and more particularly to mechanisms suitable for use on winding machines and other machines in which reciprocating traverse mechanisms are useful.

The prior art comprises a wide variety of mechanisms suitable for causing a carriage to move reciprocally between predetermined positions of traverse. An important object is to cause the carriage to move at a precisely controlled speed, which may or may not be variable, throughout the displacement between its limits of traverse.

An ideal traverse mechanism would cause the carriage to reverse its direction of movement instantaneously with no variation in the magnitude of the traversing velocity. In practice, this ideal has been approached to varying degrees, subject to limitations caused by the inertia of the parts, backlash, wear and limitations imposed by the particular choices of mechanism. The prior art includes many mechanisms of complex design, devised for minimizing the effects of these practical limitations. Such complex devices are expensive to manufacture, maintain and repair.

This invention comprises a relatively simple structure for a traverse mechanism, which reliably satisfies the above-mentioned objects, and also provides means for independently varying the limits of traverse. According to this invention two lead screws are provided for alternately moving the carriage in the opposite directions of traverse. The carriage is provided with a shift member which is movable thereon between two positions. The shift member has a pair of partial nuts thereon, one of the partial nuts engaging one of the lead screws in one position of the shift member, and the other partial nut engaging the other lead screw in the other position of the shift member. The carriage also has a pair of latches mounted thereon, each adapted to retain one of the partial nuts in engagement with a lead screw. Latch actuators are independently adjustably located in positions corresponding to the respective desired limits of traverse of the carriage, in which positions they trip the respective latches and cause the shift member to move between its two said positions to effect reversal of the carriage movement.

DESCRIPTION OF THE DRAWING

FIG. 1 is a view in plan of a preferred embodiment, illustrated for application to a winding machine.

FIG. 2 is a partial front elevation showing a latch engaging the shift member with the carriage at a position between its limits of traverse.

FIG. 3 is a side elevation corresponding to FIG. 2.

FIG. 4 is a partial front elevation showing a latch disengaged from the shift member with the carriage moving in the opposite direction to that illustrated in FIG. 2.

FIG. 5 is a side elevation corresponding to FIG. 4.

DETAILED DESCRIPTION

FIG. 1 shows a winding machine 12 for winding a material 14 such as but not limited to thread, wire, ribbon, braid, yarn, elastic or rope, in successive courses such as 16 and 18 on a spool 20. The spool 20 is rotated at a controlled speed by a suitably powered drive shaft 22 through a drive belt 24 and pulleys 26 and 28. The pulley 28 is secured to a shaft 30 to which the spool 20 is keyed.

The material 14 passes through a pair of spaced guides each comprising a hole 32 in a bracket 34 which is fastened to a traversing carriage 36. The bracket 34 is shown in FIG. 1 with a portion broken away for clarity of illustration. The carriage has a pair of bearings 38 and 40, preferably longitudinal ball bearings, which are respectively longitudinally movable on a carriage support comprising fixed parallel shafts 42 and 44.

Mutually parallel lead screws 46 and 48 are situated relative to the carriage in position for alternate engagement therewith, as hereinafter described, to cause it to traverse between predetermined limit positions, according to the length of the spool 20 or any portion thereof over which the courses such as 16 and 18 are to be applied. The lead screws 46 and 48 have the same thread pitch and rotate at the same angular velocity, being mutually engaged by identical spur gears 50 and 52.

The lead screws are driven by an adjustable speed mechanism generally designated at 54, comprising a pair of cones 56 and 58, an interconnecting drive belt 60 and belt shift means 62. Mechanisms such as 54 are well known in the art, and any known equivalent thereof may be substituted as a matter of choice. In any case the speed of the lead screws is controlled in a known manner to move the bracket 34 for delivery of the material 14 to the spool 20, so that successive turns are evenly applied. In its broadest application, the invention is applicable to any known drive means for imparting fixed or adjustable or variable speed to the shafts 46 and 48.

The mechanism for alternate engagement of the carriage 36 with the lead screws 46 and 48 is next described. A bracket 64 is secured to the carriage and extends therefrom between the lead screws. A shift member comprising a rocker arm 66 is pivoted on a screw 68 threaded into the bracket 64. The rocker arm is formed with a pair of partial nuts 70 and 72 respectively engageable with the threads on the lead screws 46 and 48. The thread sense and directions of rotation of the lead screws are obviously adapted for moving the carriage in opposite directions.

A pair of latches 74 and 76 are pivoted on screws 78 and 80 threaded into opposite sides of the carriage 36. The latches are of identical form, and each has surfaces 82 and 84 forming a notch engageable with an end of the rocker arm 66 to retain it in a position wherein a partial nut is engaged with a lead screw. For example, the latch 74 as shown in FIGS. 2 and 3 engages the rocker arm 66 to retain the partial nut 72 in engagement with the lead screw 48.

If desired, the latches may be modified in structure to make the positions of the rocker arm engaging surfaces 82 variable in relation to the pivotal axes of the latches. This may be done conveniently by making each latch of two parts adjustably threaded together, one part including a pivot hole for a screw 78 and the other part having a surface 82.

As shown in FIGS. 4 and 5, each latch is pivotal to disengage its surfaces 82 and 84 from the rocker arm to permit the latter to pivot to a position in which the adjacent partial nut is engaged with the adjacent lead screw. Preferably, torsion springs 86 and 88 are provided for urging each of the latches in the appropriate directions for causing the surfaces 82 and 84 to reengage the rocker arm when the latter is again depressed to the position shown in FIG. 2. Also, the pivotal axes of the screws 78 and 80 are located over the rocker arm to cause the latches to rotate by gravity toward their respective positions of engagement with the rocker arm.

The latches 74 and 76 are located on opposite sides of the rocker arm 66 so that forces in opposite directions may be applied for disengaging the latches therefrom. These forces are applied by a pair of latch actuators 90 and 92 respectively threaded on shafts 94 and 96. The latter shafts are rotatable manually or by any desired means to locate each of the latch actuators at a selected position corresponding to a limit of traverse of the carriage 36. Each latch actuator has a surface 98 (FIG. 2) in position for engaging the surface 84 of the corresponding latch to disengage it from the rocker arm when the carriage has reached the corresponding limit position. Each latch actuator is also provided with a lever 100 pivotal on a pin 102, with a compression spring 104 urging the lever upwardly toward the bottom surface of the rocker arm. The lever 100 is located to engage the rocker arm when the carriage reaches a position in advance of its limit position, and to maintain engagement therewith until the carriage reaches the limit position at which the surface 84 of the latch contacts the surface 98 to disengage the latch from the rocker arm. Thereupon, the rocker arm is forced by the lever to a position in which the previously unengaged partial nut becomes engaged with a lead screw and the other latch is enabled to engage the rocker arm to retain it in this position.

It will be noted that numerous variations in the structure of the latch actuators can be employed. For example, there can be a plurality of such actuators on each side of the carriage for selective engagement with the same latch. In this case the actuators are provided with means to place them either in a first position for engaging the rocker arm and latch as illustrated, or in an alternate position that is removed from the path of travel of the rocker arm and latch. These movements may be controlled manually or automatically by any known means.

Also, although only a single carriage 36 has been shown, more than one carriage may be mounted on the shafts 42 and 44 or on an equivalent carriage support. In this case each carriage is provided with the desired traversing mechanism.

Further, although only a single guide member 34 has been shown, the carriage or carriages may each have more than one guide member each supplying a separate takeup spool.

The invention is herein described as applied to a winding machine for purposes of illustration, but its utility extends as well to other machines requiring a reciprocating traverse movement. Examples include, without limitation thereto, a large number of machine tools such as cutting and grinding tools with traverse mechanisms for tools or workpieces.

Other variations in applications and in the described mechanism will occur to those skilled in the art, and may be employed without departing from the spirit or scope of this invention.

I claim:

1. In a traverse mechanism comprising a pair of parallel lead screws, a carriage support, a carriage mounted on the support for reciprocating movement longitudinally of the lead screws, a rocker arm pivotal on the carriage and having a pair of ends extending in opposite directions from its pivotal axis, each end having a partial nut thereon, said rocker arm being pivotal between a first position in which one of the partial nuts is engaged with one of the lead screws and a second position in which the other partial nut is engaged with the other lead screw, the lead screws rotating in directions for causing reversal of carriage movement when the rocker arm is moved from each said position to the other, the combination with said mechanism of means for mounting the rocker arm pivotally about an axis parallel to the direction of movement of the carriage, a pair of latches on the carriage each movable to and from a latching position engaging one end of the rocker arm to retain the partial nut on the opposite end thereof in engagement with a lead screw, and a pair of latch actuators each located in a predetermined position relative to the carriage support and comprising an abutment engageable directly by a latch and operable thereupon to move said latch from its latching position when the latch reaches a position in which the carriage is at a predetermined limit of movement, and means to move the rocker arm from one to the other of said first and second positions upon each said movement of a latch from its latching position.

2. The combination of claim 1, in which the last-recited means are adapted to urge an end of the rocker arm resiliently from one to the other of said first and second positions as the latch engaging said end in latching position approaches a corresponding abutment.

3. The combination of claim 1, in which the latches are each pivotal on the carriage.

4. The combination of claim 1 with means to vary the locations of the latch actuators longitudinally of the lead screws.

5. The combination of claim 1, in which each means to move the rocker arm is mounted in fixed relation to a corresponding latch actuator and spring loaded to apply a force to the rocker arm at right angles to the direction of movement of the carriage to move the rocker arm upon disengagement of a latch therefrom by said corresponding latch actuator.

6. The combination of claim 5, with means to adjust the location of each means to move the rocker arm and corresponding latch actuator longitudinally of the lead screws.

7. The combination of claim 6, having an adjustment screw extending longitudinally of a lead screw, a latch actuator being threaded thereon.

8. The combination of claim 3, in which the pivotal axis of each latch is located to cause it to pivot by gravity toward a position for engaging the rocker arm.

9. The combination of claim 1, with spring means urging each latch toward its latching position.

10. The combination of claim 1, in which the carriage support includes a shaft and the carriage is slidable thereon.

11. The combination of claim 1, in which each latch has means tending to move it toward its latching position.

12. The combination of claim 5, in which the means to move the rocker arm includes a lever adapted to engage the rocker arm at a position of the carriage spaced from said limit of movement and to remain in engagement with the rocker arm until the carriage reaches said limit of movement.

* * * * *